United States Patent [19]

Höppel

[11] Patent Number: 4,532,906

[45] Date of Patent: Aug. 6, 1985

[54] FUEL SUPPLY SYSTEM

[75] Inventor: Rainer Höppel, Stuttgart, Fed. Rep. of Germany

[73] Assignee: Robert Bosch GmbH, Stuttgart, Fed. Rep. of Germany

[21] Appl. No.: 486,763

[22] Filed: Apr. 20, 1983

[30] Foreign Application Priority Data

Aug. 10, 1982 [DE] Fed. Rep. of Germany ..... 3229716

[51] Int. Cl.[3] ..... F02M 55/02

[52] U.S. Cl. ..... 123/470; 239/533.12; 239/585

[58] Field of Search ..... 123/470, 471, 472, 478; 239/533.12, 585, 474

[56] References Cited

U.S. PATENT DOCUMENTS

| | | | |
|---|---|---|---|
| 1,977,005 | 10/1934 | Mock | 239/533.12 |
| 3,893,434 | 7/1975 | Thatcher et al. | 123/470 |
| 4,235,375 | 11/1980 | Melotti | 123/470 |
| 4,254,915 | 3/1981 | Muller | 239/533.12 |
| 4,351,305 | 9/1982 | Isogai et al. | 123/470 |
| 4,360,161 | 11/1982 | Claxton et al. | 239/585 |
| 4,373,491 | 2/1983 | Knapp | 123/472 |
| 4,387,677 | 6/1983 | Guerrier | 239/585 |
| 4,416,423 | 11/1983 | Krauss et al. | 239/585 |

FOREIGN PATENT DOCUMENTS

| | | | |
|---|---|---|---|
| 2928350 | 2/1981 | Fed. Rep. of Germany | 123/472 |
| 400836 | 11/1933 | United Kingdom | 239/533.12 |
| 950776 | 2/1964 | United Kingdom | 123/470 |

*Primary Examiner*—Magdalen Y. C. Moy
*Attorney, Agent, or Firm*—Edwin E. Greigg

[57] ABSTRACT

A fuel supply system for internal combustion engines, in which a fuel injection valve is disposed upstream of a throttle device in an intake tube, from which valve a fuel stream which is asymmetrical relative to the throttle device emerges in order to influence the uniformity of mixture distribution to the cylinders of the engine. An asymmetrical fuel stream can be attained, by way of example, by inclining the fuel injection valve by a small angle ($\alpha$) relative to the axis of the intake tube at the throttle device.

6 Claims, 6 Drawing Figures

FUEL SUPPLY SYSTEM

The invention is based on a fuel supply system as generally defined by the ensuing specification which is finally claimed. A fuel supply system is already known, in which the fuel supply is effected in common for all the cylinders of the internal combustion engine by means of one fuel injection valve, which is disposed coaxially in the intake tube upstream of the throttle valve such that the ejected fuel stream extends symmetrically over the throttle valve. However, it has been demonstrated that a symmetrical fuel system of this kind does not necessarily produce a uniform distribution of the mixture to the individual cylinders of the engine. The attempt has therefore been made to improve the uniformity of mixture distribution to the individual cylinders by making the flow courses to the individual cylinders of different lengths, or by inserting guide bodies or throttle restrictions in the flow courses.

OBJECT AND SUMMARY OF THE INVENTION

The fuel supply system according to the invention and having the characteristics disclosed hereinafter has the advantage over the prior art that the uniformity of mixture distribution to the individual cylinders can be influenced and corrected in a simple manner.

By means of the further characteristics disclosed herein, other advantageous embodiments of and improvements to the fuel supply system disclosed in the application can be attained.

It is advantageous to direct the fuel stream asymmetrically with respect to the throttle device by means of slightly inclining the fuel delivery element.

It is likewise advantageous, in a fuel delivery element provided with swirl conduits, to influence the embodiment of the fuel stream such that varying angles of inclination are imparted to the swirl conduits, and/or that the swirl conduits have varying cross sections and/or are disposed asymmetrically with respect to the axis of the fuel delivery element, and/or that a guide body which at least partially diverts the fuel stream is provided downstream of the swirl conduits.

The present invention relates to further improvements in the inventive concept disclosed in application Ser. No. 376,463, filed May 10, 1982 and assigned to the assignee of this invention.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
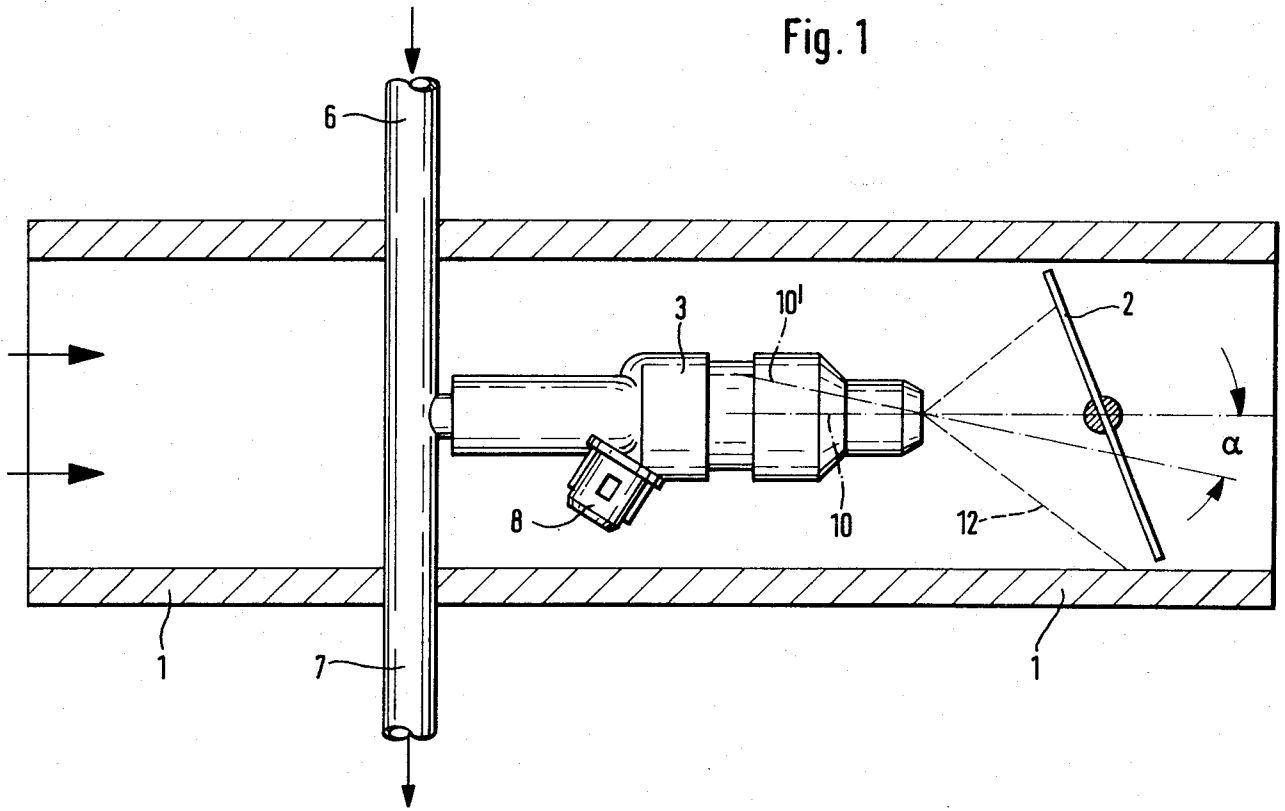
FIG. 1, in simplified form, shows a fuel supply system having a fuel delivery element disposed upstream of a throttle device.

In the fuel supply system shown by way of example in FIG. 1, the air for combustion flows downstream of a filter (not shown) in the direction of the arrows into a section 1 of an intake tube, having a throttle device 2 disposed therein and embodied as a throttle valve which leads to a plurality of cylinders (not shown) of an internal combustion engine. Upstream of the throttle valve 2, a fuel injection valve 3 which is actuatable electromagnetically is shown as an example of a fuel delivery element; the fuel can be ejected through this element in the direction of the throttle valve 2. The supply of fuel to the fuel injection valve 3 is effected in the inlet direction via an inlet line 6, and the return flow of whatever fuel is not injected takes place via a return line 7. The triggering of the electromagnetically actuated fuel injection valve 3 is effected in a known manner in accordance with operating characteristics of the engine via an electrical connection plug 8. The injection valve 3 is shown in the drawing disposed such that its axis 10, indicated by dot-dash lines, coincides with the axis of the intake tube 1. The emerging fuel stream is effected, in this position, symmetrically relative to the throttle valve 2. Now in accordance with the invention, in order to influence the uniformity of the mixture distribution to the individual engine cylinders, the fuel injection valve 3 should be inclined slightly relative to the axis 10 such that the axis 10' of the new position forms a small acute angle $\alpha$ with the intake tube axis 10. In this new position, inclined in accordance with the invention, the fuel stream 12 indicated by dashed lines and ejected by the fuel injection valve 3 extends asymmetrically relative to the throttle valve 2 and thus to the intake tube 1 as well. By the suitable selection of the angle of inclination, the uniformity of mixture distribution to the individual cylinders of the engine can be influenced in the desired manner.

Figure 2:
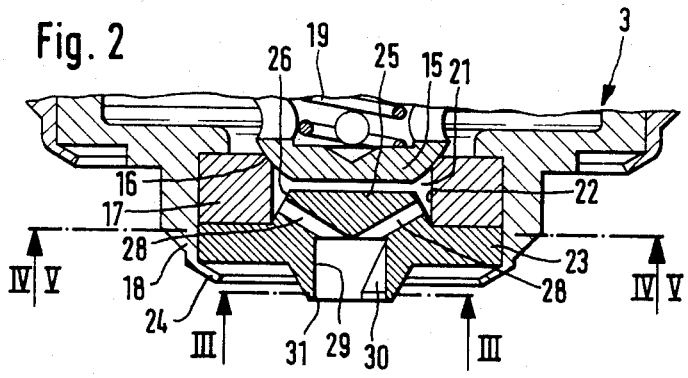
FIG. 2 is a partial section taken through a fuel delivery element.
Figure 3:
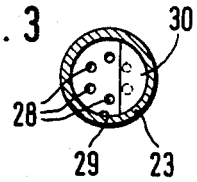
FIG. 3 is a section taken along the line III—III of FIG. 2.

In FIG. 2, the fuel injection valve 3 is shown in a partial view, in which a valve element 15 of spherical embodiment cooperates with a fixed valve seat 16, which is embodied in a valve seat body 17. The valve seat body 17 is inserted into a nozzle carrier 18. The valve element 15 can be raised from the valve seat 16 electromagnetically by an armature (not shown) counter to the force of a spring 19, so that fuel can flow past the valve seat 16 into a collection chamber 21, which is defined by the valve element 15, a bore 22 of the valve seat body 17, and a swirl body 23 disposed downstream of the valve seat body 17. A flange 24 of the nozzle carrier 18 surrounds and engages a face of the swirl body 23 remote from the valve seat body 17, thereby fixing the valve seat body 17 and the swirl body 23 in their respective positions. The swirl body or means 23 has a protrusion 25 projecting into the collection chamber 21, and the end face of the protrusion which is oriented toward the valve element 15 is flattened; swirl conduits 28 which are open toward the collection chamber 21 branch off from the circumferential wall 26 at the side of the protrusion 25, this wall 26 having a conical course by way of example. The swirl conduits 28 may be inclined at an angle to the valve axis in a known manner, and they discharge into a swirl chamber 29. As also shown in FIG. 3, a guide body 30 is disposed in the swirl chamber 29, by means of which at least a portion of the fuel stream downstream of the swirl conduits is diverted in such a manner that the fuel stream emerging at the pointed end 31 of the swirl chamber 29 is asymmetrical. Thus by the suitable selection of the shape and disposition of the guide body 30, which may by way of example be a sheet-metal element, influence can be exerted both on the shape of the fuel injection stream and accordingly on the uniformity of mixture distribution to the cylinders.

Figure 4:
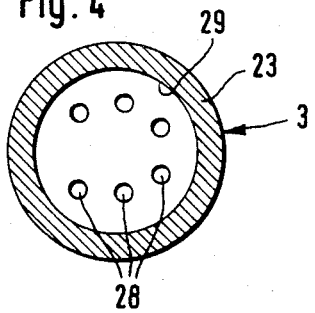
FIG. 4 is a section taken along the line IV—IV of FIG. 2.

FIG. 4 shows only a section through the swirl body 23 of the fuel injection valve 3, in which an asymmetrical fuel stream is attained by disposition of the swirl conduits 28 asymmetrically relative to the valve axis.

Figure 5:
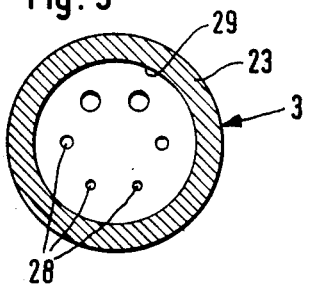
FIG. 5 is a section taken along the line V—V of FIG. 2.

The exemplary embodiment of the invention shown in FIG. 5, which again shows only a section through the swirl body 23, has swirl conduits 28 having different cross sections, thereby producing an asymmetrical fuel stream.

Figure 6:
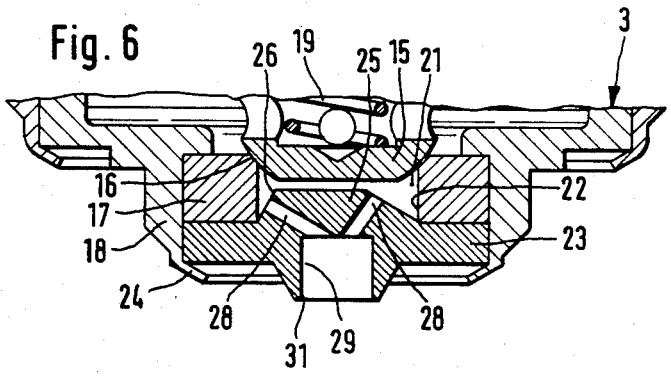
FIG. 6 is a partial section taken through a fuel delivery element.

In a further exemplary embodiment of the invention, shown in FIG. 6, an asymmetrical fuel stream is attained by providing that the angles of inclination of the swirl conduits 28 relative to the valve axis are different.

In addition to the above-mentioned provisions for attaining the best possible uniformity of mixture distribution, it may be advantageous to support the fuel injection valve 3 such that it is capable of rotation, and by rotating the fuel injection valve to effect a supplementary correction of the uniformity of mixture distribution to the individual cylinders of the engine.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel supply system for internal combustion engines comprising an intake tube having a longitudinal axis, a throttle device in said intake tube, a fuel delivery element supported in said intake tube upstream of said throttle device such that incoming air surrounds said fuel delivery element, said fuel delivery element including injection means arranged to eject fuel asymmetrically toward said throttle device, said injection means including swirl means, said swirl means further provided with means defining apertures arranged to communicate with a swirl chamber and guide means in said swirl chamber adapted to partially divert said fuel stream downstream of said apertures.

2. A fuel supply system for internal combustion engines comprising an intake tube having a longitudinal axis, a throttle device in said intake tube, a fuel delivery element supported in said intake tube upstream of said throttle device such that incoming air surrounds said fuel delivery element, said fuel delivery element including a longitudinal axis, injection means arranged to eject fuel asymmetrically toward said throttle device, said injection means of said fuel delivery element has a plurality of swirl apertures, by means of which a swirling movement is imparted to the fuel to be delivered to the intake tube, and wherein said swirl apertures are disposed asymmetrically relative to said axis of said fuel delivery element.

3. A fuel supply system for internal combustion engines comprising an intake tube having a longitudinal axis, a throttle device in said intake tube, a fuel delivery element supported in said intake tube upstream of said throttle device such that incoming air surrounds said fuel delivery element, said fuel delivery element including injection means arranged to eject fuel symmetrically toward said throttle device, said injection means of said fuel delivery element has a plurality of swirl apertures, by means of which a swirling movement is imparted to the fuel to be delivered to said intake tube, and wherein said swirl apertures have different cross section.

4. A fuel supply system for internal combustion engines comprising an intake tube having a longitudinal axis, a throttle device in said intake tube, a fuel delivery element supported in said intake tube upstream of said throttle device such that incoming air surrounds said fuel delivery element, said fuel delivery element including a longitudinal axis, injection means arranged to eject fuel asymmetrically toward said throttle device, said injection fuel delivery element has a plurality of swirl apertures each with different angles of inclination relative to said longitudinal axis of said fuel delivery element, by means of which a swirling movement is imparted to the fuel to be delivered to the intake tube.

5. A fuel supply system for internal combustion engines comprising an intake tube having a longitudinal axis, a throttle device in said intake tube, a fuel delivery element supported in said intake tube upstream of said throttle device such that incoming air surrounds said fuel delivery element, said fuel delivery element including a longitudinal axis, injection means arranged to eject fuel asymmetrically toward said throttle device, said injection means of said fuel delivery element further includes an asymmetrical head portion which projects into a collection chamber and said head portion is penetrated by apertures disposed at different angles relative to said longitudinal axis of said fuel delivery element which terminate in a swirl chamber.

6. A fuel supply system as defined by claim 5, further wherein said apertures in said head portion have different cross sections.

* * * * *